US005592930A

United States Patent [19]

Roberts et al.

[11] Patent Number: 5,592,930

[45] Date of Patent: Jan. 14, 1997

[54] ARROW REST

[75] Inventors: Kent S. Roberts; Brent J. Roberts, both of American Fork, Utah

[73] Assignee: Inventive Technology, American Fork, Utah

[21] Appl. No.: 396,187

[22] Filed: Feb. 24, 1995

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 3,935,854 | 2/1976 | Troncoso | 124/44.5 X |
| 4,299,195 | 11/1981 | Norris | 124/44.5 X |
| 4,318,390 | 3/1982 | Trotter | 124/44.5 |
| 4,473,058 | 9/1984 | Terry | 124/44.5 X |
| 4,476,846 | 10/1984 | Carville | 124/44.5 |
| 4,492,214 | 1/1985 | Kielhoffer | 124/44.5 |
| 4,796,597 | 1/1989 | Farro | 124/44.5 |
| 4,947,823 | 8/1990 | Larson | 124/24.1 X |
| 5,353,778 | 10/1994 | Blankenship | 124/44.5 |
| 5,372,119 | 12/1994 | Kidney | 124/44.5 |
| 5,383,441 | 1/1995 | Lightcap, Jr. | 124/44.5 |
| 5,385,135 | 1/1995 | Saunders | 124/44.5 |
| 5,386,814 | 2/1995 | Denton | 124/44.5 |
| 5,400,763 | 3/1995 | Mazza | 124/44.5 |
| 5,421,314 | 6/1995 | Kidney | 124/44.5 |

*Primary Examiner*—John A. Ricci
*Attorney, Agent, or Firm*—Mallinckrodt & Mallinckrodt

[57] ABSTRACT

An archery arrow rest includes a base to be secured to the handle or riser of an archery bow and a pair of spaced arrow support fingers extending from the base to support an arrow shaft thereon and therebetween. The fingers are configured, such as by the provision of a spring configuration on each finger, to resiliently move vertically and horizontally to an extent to follow up and down and side-to-side movement of an arrow supported by the rest during shooting of the arrow.

7 Claims, 2 Drawing Sheets

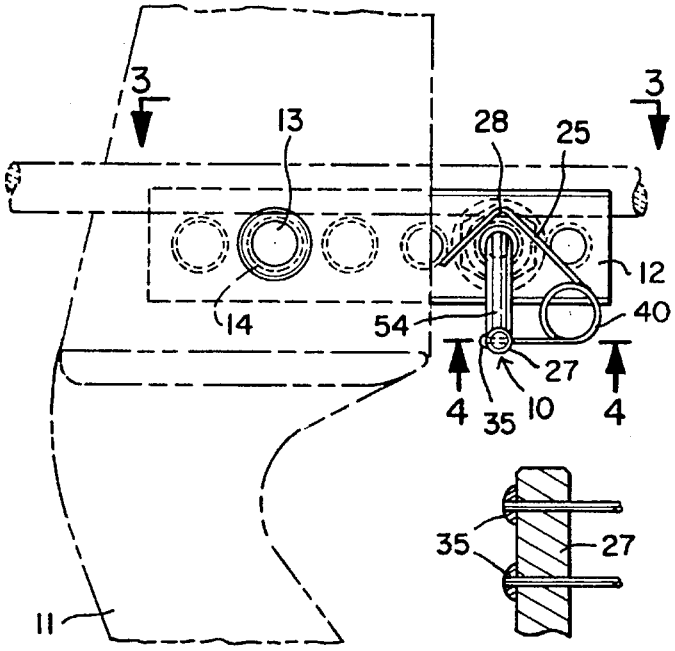
FIG. 1
FIG. 4
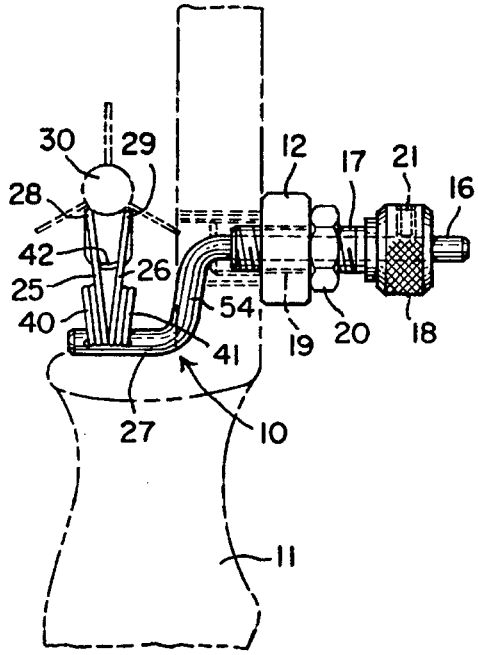
FIG. 2
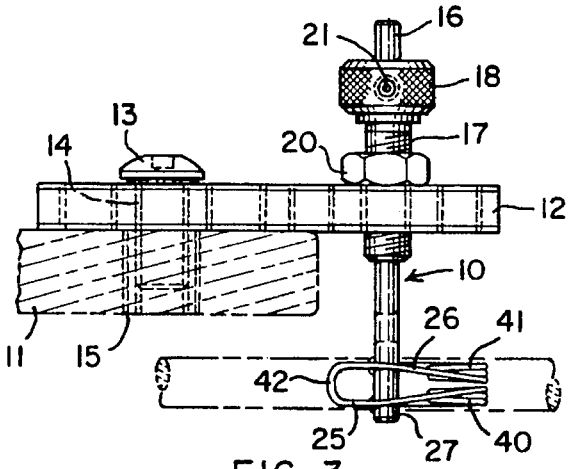
FIG. 3
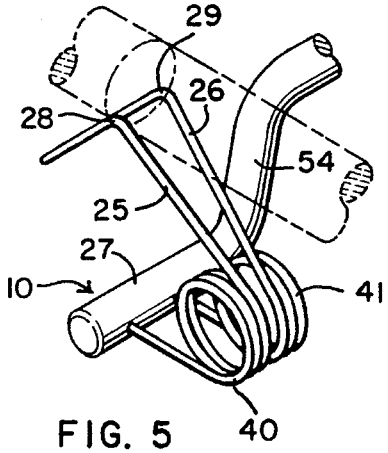
FIG. 5
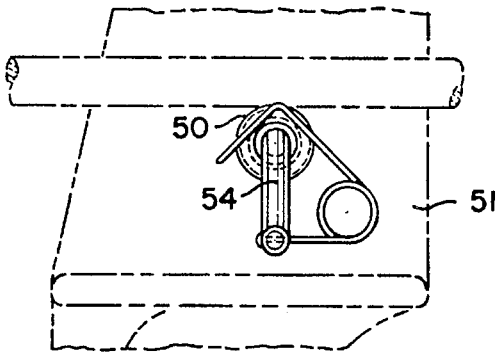
FIG. 6
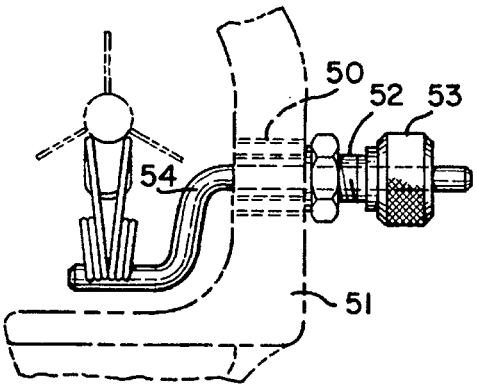
FIG. 7

ARROW REST

BACKGROUND OF THE INVENTION

1. Field

The invention is in the field of archery arrow rests.

2. State of the Art

There are a wide variety of archery arrow rests currently available to support an arrow with respect to an archery bow during the drawing and aiming of an archery bow and during the release of the arrow. During the release of the arrow, the arrow has a tendency to pitch or porpoise, i.e., to move or flex up and down in a vertical direction, and a tendency to yawl or fish tail, i.e., to move or flex horizontally from side to side. Ideally, an arrow rest should support and guide the arrow during this movement and should allow free passage of the arrow vanes without hitting the arrow rest.

SUMMARY OF THE INVENTION

According to the invention, an archery arrow rest which supports an arrow during vertical and side-to-side movement includes arrow support fingers which support an arrow shaft thereon and resiliently move both vertically and horizontally with the arrow. The rest includes a rest base which is secured to a bow handle or riser in normal manner or through use of an adapter, and a pair of spaced arrow support fingers extend from the base to support an arrow shaft thereon and therebetween. The arrow supporting fingers are spaced at the respective areas of contact with the arrow shaft less than the diameter of the arrow shaft so that the arrow shaft is supported between the fingers. The fingers are configured to resiliently move vertically and horizontally to follow up and down and side-to-side movement of an arrow supported by the fingers during shooting of the arrow. It is preferred that the fingers move in unison and for that purpose, the ends of the fingers away from the base may be joined together.

In a preferred embodiment of the rest, the fingers are formed of stainless steel, flexible but normally shape retaining, wire secured to the rest base and wound into a spring configuration adjacent the rest base with the fingers extending from the spring configuration. The wound spring configuration provides vertical and horizontal resilience to the fingers. With the fingers formed of wire, the spacing of the fingers can be adjusted by bending the wire beyond its resilient point to provide a shape retaining bend to space the fingers as desired. In this way, the rest can be adjusted for various diameters of arrow shafts. This is advantageous because currently available carbon composite arrow shafts are of significantly smaller diameter than aluminum arrow shafts.

The spacing of the fingers may be chosen for two alternate configurations, one in which an arrow vane will pass freely between the fingers, and one in which the arrow vanes will pass over and to the side of the fingers.

THE DRAWINGS

The best mode presently contemplated for carrying out the invention is illustrated in the accompanying drawings, in which:

FIG. 1 is a fragmentary side elevation of a bow handle or riser with an arrow rest of the invention mounted thereto;

FIG. 2, a fragmentary rear elevation of the bow riser shown in FIG. 1;

FIG. 3, a horizontal section taken on the line 3—3 of FIG. 1;

FIG. 4, a fragmentary, enlarged horizontal section through the end of the arrow rest base;

FIG. 5, a fragmentary pictorial view of the rest of FIG. 1;

FIG. 6, a fragmentary side elevation of a bow handle or riser similar to that of FIG. 1, but showing a different mounting for the rest;

FIG. 7, a fragmentary rear elevation of the bow riser of FIG. 6;

FIG. 8, a rear elevation of a rest showing a different embodiment;

FIG. 9, a top plan view of the rest of FIG. 8; and

FIG. 10, a rear elevation of a rest showing a different embodiment of rest base.

DETAILED DESCRIPTION OF THE ILLUSTRATED EMBODIMENTS

Figure 9:
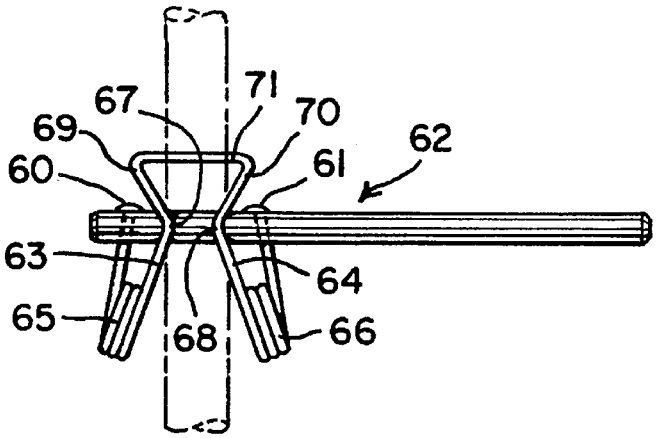

As shown in FIGS. 1–5, the arrow rest of the invention includes a rest base 10 which is secured to an archery bow handle or riser 11 through an adapter 12 secured to the riser 11 by a screw 13 extending through a selected hole 14 of a plurality of adapter holes provided in adapter 12. The screw 13 is threaded into a normally provided threaded insert 15 in riser 11. Rest base 10 may take the form of a stainless steel rod with an end portion 16 thereof extending into and through tubular mounting bracket 17. Mounting bracket 17 is externally threaded and includes knurled end knob 18 for holding and manipulating mounting bracket 17. Mounting bracket 17 is screwed into a selected internally threaded adapter hole 19 through adapter 12, and a locking nut 20 is tightened against adapter 12 to secure the bracket 17 in adapter 12 in desired position. A set screw 21 in knob 18 is tightened against rest base end portion 16 to secure the rest base to the riser 11.

A pair of arrow support fingers 25 and 26 extend upwardly from an end portion 27 of rest base 10 to respective arrow contact areas 28 and 29 upon which an arrow shaft 30 to be shot from the bow actually rests. In the embodiment shown, the arrow support fingers 25 and 26 are formed by spring type wire, such as stainless steel wire, which can be bent, but which is normally shape retaining unless bent beyond a certain resilient point. Preferably, the wire ends 35 and 36 are inserted through holes 37 and 38 in rest base 10. The wire ends are then soldered to rest base 10. When soldering the wire ends to rest base 10, rest base 10 acts as a heat sink to prevent overheating of the wire away from the rest base 10 to a temperature to destroy its resilience.

Each of the wires extending from securement to the rest base 10 is wound as at 40 and 41, respectively, into spring configuration adjacent rest base 10, before extending upwardly toward arrow contact areas 28 and 29. Arrow contact areas 28 and 29 are formed by bends in the wires so that the wires then extend downwardly and are joined by a transverse connecting length 42. It is preferred that the fingers be formed of a single length of wire bent to the described and illustrated configuration with opposite ends 35 and 36 of the length of the wire secured to the rest base. Also, while three turns of wire for each of the spring configurations is shown and has been found satisfactory, fewer turns could be used in some cases depending upon the wire used or more turns could be used. The spring configuration provides the desired resilience to the fingers so the arrow contact areas can move up and down in a vertical direction and move side-to-side in a horizontal direction under the influence of an arrow shaft resting on and moving over the arrow contact areas. The number of turns required in the spring configuration is that necessary to provide the desired vertical and horizontal resilience to the arrow contact areas.

The fingers may take several alternate configurations. With the configuration of FIGS. 1–5, wire ends 35 and 36 are secured to the rest base in relatively close proximity and the finger spring configurations are relatively close together so that the support fingers diverge from the spring configurations 40 and 41 to the arrow contact areas 28 and 29, respectively. This provides a relatively narrow space between the fingers. With this configuration, it is preferred that the arrow be nocked in the bow with the vanes arranged as shown in FIG. 2 so that the vanes pass over the arrow contact area of the fingers without contacting the fingers.

With wire used to form the fingers, the wire can be bent beyond its resilient point so that the finger arrow contact areas 28 and 29 can be spaced further apart or closer together. The distance desired between the arrow contact areas 28 and 29 will depend upon the arrow shafts used in the making of the arrows to be shot using the rest. Arrow shafts are currently available made of aluminum and of carbon fiber composite. The composite arrows are of significantly smaller diameter than are the aluminum arrows so the distance between the contact areas of the fingers need to be adjusted depending upon the type of arrow used.

FIGS. 6 and 7 show the arrow rest of FIGS. 1–5 mounted directly to the commonly provided mounting hole 50 in riser 51 rather than being mounted through adapter 12. A mounting bracket 52 similar to mounting bracket 17 is screwed into mounting hole 50 and a set screw in knob 53 secures rest base 10 to the riser.

Figure 10:
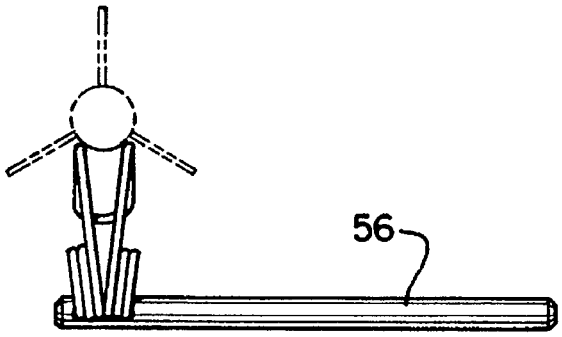

As shown in the rest embodiment of FIGS. 1–7, the rest base 10 includes a central jog portion 54 to offset the ends 27 and 16 of the rest base. This is necessary with some bows to correctly position the arrow contact areas in relation to the riser so that the arrow is supported at the correct height. In some bows, however, the rest base can be straight as shown by rest base 56 in FIG. 10, and secured directly to the riser as in FIGS. 6 and 7, or to an adapter as shown in FIGS. 1–5.

Figure 8:
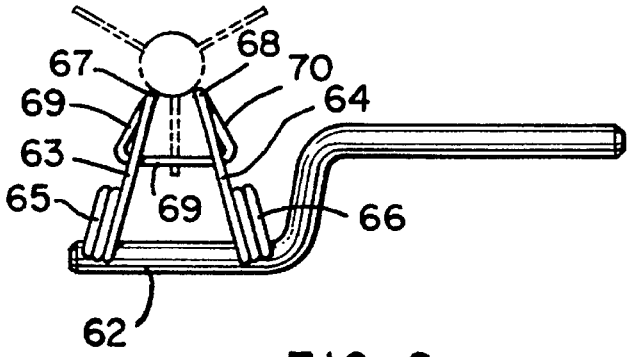

FIGS. 8 and 9 show an alternate embodiment of the rest wherein the attachment of the wire ends 60 and 61, FIG. 9, to the rest base 62 are farther apart than in the embodiment of FIGS. 1–5 and the fingers 63 and 64 extend upwardly in convergent manner from spring configurations 65 and 66 to arrow contact areas 67 and 68. The fingers then extend both downwardly and outwardly as at 69 and 70 to transverse connecting length 71. This embodiment provides a wide space between the fingers (the spacing between the arrow contact areas 67 and 68 is the same as in the embodiment of FIGS. 1–5) to allow an arrow vane to easily pass therethrough without hitting the fingers. The arrow may be nocked in the bow with the vane orientation as shown in FIG. 8.

While a closely spaced diverging finger embodiment and a widely spaced converging finger embodiment have been shown and described, various configurations between these could be used. Further, while spring wire has been described for forming the fingers, various other materials could be used and plastic in some configurations could be used to provide fingers with the required up and down and side-to-side movement.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. An archery arrow rest comprising:

a rest base;

means for securing the rest base to an archery bow;

a pair of spaced arrow support fingers extending from the base to support an arrow shaft thereon and therebetween, said fingers each having an arrow contact area and being spaced apart at their respective arrow contact areas less than the diameter of the arrow, said fingers being configured to resiliently move vertically and horizontally to an extent to follow up and down and side-to-side movement of an arrow supported by the rest during shooting of the arrow and being formed of resilient, but normally shape-retaining wire secured to the rest base, the wire forming each finger being wound in spring configuration adjacent the rest base, with the fingers extending therefrom to provide resilience to the fingers, and the fingers being joined together so that they move together.

2. An archery arrow rest according to claim 2, wherein each of the spring configurations includes a spring winding of about three turns adjacent the rest base.

3. An archery arrow rest according to claim 2, wherein the arrow support fingers are spaced sufficiently to allow the vane of an arrow to pass therebetween.

4. An archery arrow rest according to claim 2, wherein the arrow support fingers are spaced to support an arrow shaft between vanes of the arrow so that the vanes of the arrow pass above the fingers.

5. An archery arrow rest according to claim 1, wherein the arrow contact area is formed by a bend in the wire.

6. An archery arrow rest according to claim 1, wherein the arrow support fingers are spaced sufficiently to allow the vane of an arrow to pass therebetween.

7. An archery arrow rest according to claim 1, wherein the arrow support fingers are spaced to support an arrow shaft between vanes of the arrow so that the vanes of the arrow pass above the fingers.

* * * * *